US006208365B1

(12) United States Patent
Nakamura et al.

(10) Patent No.: US 6,208,365 B1
(45) Date of Patent: Mar. 27, 2001

(54) VACUUM FLUORESCENT PRINTER

(75) Inventors: Shigetaka Nakamura; Hiromichi Morishima; Hidekazu Tsuji, all of Wakayama (JP)

(73) Assignee: Noritsu Koki Co., Osaka (JP)

( * ) Notice: Subject to any disclaimer, the term of this patent is extended or adjusted under 35 U.S.C. 154(b) by 0 days.

(21) Appl. No.: 09/217,178

(22) Filed: Dec. 21, 1998

(30) Foreign Application Priority Data

Dec. 26, 1997 (JP) ..... 9-361158
Dec. 26, 1997 (JP) ..... 9-361159

(51) Int. Cl.[7] ..... B41J 2/47
(52) U.S. Cl. ..... 347/232; 347/115; 347/122
(58) Field of Search ..... 347/232, 15, 130, 347/131, 135, 230, 236, 237, 238, 297, 120, 121, 122, 115; 313/495, 497, 306, 308, 310

(56) References Cited

U.S. PATENT DOCUMENTS

| | | | | |
|---|---|---|---|---|
| 4,475,115 | | 10/1984 | Garbe et al. | 347/130 |
| 4,748,453 | * | 5/1988 | Lin et al. | 347/40 |
| 5,034,756 | | 7/1991 | Taira | 347/232 |
| 5,043,743 | * | 8/1991 | Habets et al. | 347/238 |
| 5,592,205 | | 1/1997 | Shimizu et al. | 347/115 |
| 5,774,146 | * | 6/1998 | Mizutani | 347/15 |
| 5,892,524 | * | 4/1999 | Silverbrook | 347/15 |

FOREIGN PATENT DOCUMENTS

| | | |
|---|---|---|
| 0367550 | 5/1990 | (EP) . |
| 0437023 | 7/1991 | (EP) . |
| 0713330 | 1/1997 | (EP) . |

OTHER PUBLICATIONS

Patent Abstracts of Japan, (05165108) vol. 017, No. 566 (p–1629), Jun. 29, 1993.

Patent Abstract of Japan, (63079465) vol. 012, No. 314 (E–649), Apr. 9, 1988.

Patent Abstract of Japan, (03248175) vol. 016, No. 42 (P–1306), Nov. 6, 1991.

* cited by examiner

*Primary Examiner*—N. Le
*Assistant Examiner*—Lamson D. Nguyen
(74) *Attorney, Agent, or Firm*—Fulbright & Jaworski, LLP

(57) ABSTRACT

A vacuum fluorescent printer including a print head (60) having luminous blocks (32, 33, 34) each having a plurality of luminous elements arranged in a main scanning direction for irradiating a photosensitive material with light released from phosphorous objects to which electrons are applied based on a drive signal, thereby forming dots on the photosensitive material. A further luminous block (32*b*) is provided which is spaced from the luminous blocks (32*a*, 33, 34) in the sub-scanning direction and used for printing a particular color among the three colors (R, G, B) Each dot of the particular color is formed by light from a plurality of luminous blocks (32*a*, 32*b*). A printer controller (7*c*) is provided for generating a pulsed drive signal as the drive signal. The number of pulses in the drive signal is determined based on a density value of the image data, and the slower a moving speed is in the sub-scanning direction, to the larger pulse width the drive signal is set.

4 Claims, 12 Drawing Sheets

VACUUM FLUORESCENT PRINTER

BACKGROUND OF THE INVENTION

1. Field of the Invention

This invention relates to a vacuum fluorescent printer with a print head including luminous blocks each having a plurality of luminous elements arranged in a main scanning direction for emitting, to a photosensitive material, light released by applying electrons to phosphorous objects based on a drive signal, thereby forming dots on the photosensitive material, the luminous blocks and photosensitive material being movable relative to each other in a sub-scanning direction to form images based on image data on the photosensitive material.

2. Description of the Related Art

A fluorescent printer for forming images on a photosensitive material is disclosed in Japanese Patent Laying-Open Publication H5-92622 (corresponding to U.S. Pat. No. 5,592,205), for example. This printer has cathodes for releasing thermions, grid electrodes, and a plurality of strip-like anodes covered by phosphorous objects of a predetermined size arranged at predetermined intervals, all sealed in a vacuum case. Thermion impingement upon the phosphorous objects, i.e. light emission from the phosphorous objects, is controlled by applying control signals based on image data to the grid electrodes. Each phosphorous object corresponds to one pixel of an image, i.e. one dot. The luminous blocks have numerous phosphorous objects arranged in a main scanning direction. A latent image which is a combination of numerous dots based on image data is formed on the photosensitive material by a relative movement in a sub-scanning direction (at right angles to the main scanning direction) between the luminous blocks and photosensitive material. A color fluorescent printer for printing color images includes a print head having a read (R) luminous block, a green (G) luminous block and a blue (B) luminous block. A monochromatic fluorescent print for printing monochromatic images includes a print head having a single luminous block.

In a fluorescent printer which develops and transfers to transfer paper a latent image formed on a photoreceptor drum by light dots emitted from the luminous elements synchronously with rotation of the photoreceptor drum, sensitivity characteristics of the photoreceptor drum may be maintained at a constant high sensitivity level. Where, for example, the fluorescent printer is used for exposing a photosensitive material such as photographic printing paper exposed by a light source such as a halogen lamp providing a large quantity of light, it is necessary to expose the photosensitive material over a long period of time since each phosphorous object emits light in a rather small quantity. In addition, the sensitivity characteristics are greatly variable with different types of printing paper. Printing paper with low sensitivity characteristics requires a long exposure time. This is because there is a limitation to an increase in the quantity of light based on an increase in anode voltage, and it is difficult to adjust the quantity of light only by adjusting the anode voltage. Especially in the case of color printing paper, a particular color among R, G and B could have far lower sensitivity characteristics than the other colors. When the fluorescent printer is adjusted to the low sensitivity characteristics, printing performance is greatly reduced with a prolonged exposure time.

Further, in view of the sensitivity characteristics variable with different types of photographic printing paper, it is conceivable to combine the luminous blocks with suitable filters to adjust the quantity of light. However, this would require numerous filters to produce an optimal quantity of light for each different type of printing paper with varied sensitivity characteristics, and its adjusting operation would be troublesome. A further disadvantage is that, whenever a new type of printing paper is employed, a filter suited thereto must be provided.

SUMMARY OF THE INVENTION

The object of this invention is to provide, in connection with a vaccum fluorescent printer as noted above, a simple construction for setting an optimal quantity of light for numerous types of photosensitive materials requiring adjustment in the quantity of light.

In a first proposal made according to this invention to fulfill the above object, an additional luminous block is provided which is spaced from a luminous block in a sub-scanning direction, one monochromatic dot being formed by light from these luminous blocks.

With this construction, one dot formed by a luminous element in a predetermined position of one luminous block according to conventional practice is now formed by luminous elements in predetermined positions of a plurality of luminous blocks. Where, for example, two similar luminous blocks are provided, one dot may be exposed with twice the quantity of light. This is advantageous when using a photosensitive material having low sensitivity characteristics. Moreover, since a plurality of luminous blocks are arranged in the sub-scanning direction, emission timing of these luminous blocks may be properly adjusted to movement thereof in the sub-scanning direction relative to the photosensitive material. In this way, the same dot is exposed successively by luminous elements in predetermined positions of the plurality of luminous blocks. A majority of exposure areas may be exposed simultaneously by multiple exposure. Thus, hardly any reduction occurs in printing capability.

The above advantage of this invention is derived also from a vacuum fluorescent color printer with a print head including three RGB color luminous blocks each having a plurality of luminous elements arranged in a main scanning direction for irradiating a photosensitive material with light released from phosphorous objects to which electrons are applied based on a drive signal, thereby forming dots on the photosensitive material. For this purpose, such a color fluorescent printer has a plurality of luminous blocks arranged in the sub-scanning direction for printing at least one color among the three colors. Each dot of that particular color is formed by light from these luminous blocks. That is, at least one of the RGB color luminous blocks required to emit an increased quantity of light is accompanied by an additional luminous block. For that one color, exposure may be made with a quantity of light plural times that emitted from a single luminous block. The exposure by the plurality of luminous blocks may be performed during one relative movement in the sub-scanning direction.

In a preferred embodiment of this invention, a proposal is made to supply the plurality of luminous blocks with the same density data. Then, the density data transmitted to one luminous block may be forwarded intact to the other luminous block. It is necessary only to drive the luminous elements in timed relationship to the relative movement, which requires no great alteration to a printer controller. As a result, a quantity of light used in exposing one dot is a multiple depending on the number of luminous blocks added. It is of course possible to achieve a precise light emission quantity adjustment by supplying the plurality of luminous blocks with different density data though this would require a complicated printer controller.

As a preferred embodiment of this invention for realizing a quantity of light emission other than a multiple of a standard quantity, it is proposed to apply different voltages to anodes of the plurality of luminous blocks for the same color. Then, even when the same density data is used, one dot may be exposed with a quantity of light which is not simply a multiple of the standard quantity.

In a further preferred embodiment of this invention, a paper sensor is provided for detecting a type of printing paper acting as the photosensitive material. When a result of detection by the paper sensor indicates that the printing paper to be printed has high sensitivity characteristics, for example, a printing operation may be carried out using only one of the luminous blocks of the same type. When the printing paper has low sensitivity characteristics, a printing operation may be carried out using all of the luminous blocks for forming one dot. Thus, a suitable quantity of light emission may be selected automatically according to the type of printing paper. To adjust the quantity of light with greater precision, a construction may be employed to adjust voltages applied to individual anodes of the plurality of luminous blocks based on the result of detection by the paper sensor.

In a second proposal made according to this invention to fulfill the above-mentioned object, a vacuum fluorescent printer as described above comprises a printer controller for generating a pulsed drive signal as the drive signal, the number of pulses in the drive signal being determined based on a density value of the image data, and the slower a moving speed is in the sub-scanning direction, to the larger pulse width the drive signal is set.

With this construction, the density of image data for each dot is expressed in 256 shades, for example. When an input value is a maximum (255), the photosensitive material is exposed by applying 255 emission pulses as the drive signal during a relative movement by one dot in the sub-scanning direction. When an input value is a minimum (0), no light emission takes place during a relative movement by one dot in the sub-scanning direction. The width of the emission pulses, i.e. one emission time, is varied with the relative moving speed in the sub-scanning direction. When the relative moving speed is slow, the time required for the relative movement by one dot is long, and therefore the width of the emission pulses is increased. As a result, even if the input value of the same density is the same, a large quantity of light is used for exposure, which constitutes an adjustment of the quantity of light. For a photosensitive material requiring greater exposure, for example, the relative moving speed in the sub-scanning direction may be slowed to adjust the quantity of light to an optimal value. In this way, a substantially stepless adjustment of the quantity of light is achieved, which has been impossible with the conventional use of filters.

In one preferred embodiment of this invention, the relative movement in the sub-scanning direction between the print head and the photosensitive material is produced by a transport mechanism for transporting the photosensitive material. The transport mechanism is an essential component for feeding the photosensitive material. Image data is printed on the photosensitive material by controlling the transport mechanism to feed the photosensitive material in a timed relationship to light emission from the luminous blocks. That the luminous blocks may be fixed provides advantages of a simplified construction and in space saving.

In another preferred embodiment of this invention, the luminous blocks are movable in the sub-scanning direction by a reciprocating mechanism, the relative movement in the sub-scanning direction between the print head and the photosensitive material being produced by the reciprocating mechanism. This construction additionally needs the reciprocating mechanism for the luminous blocks. However, the photosensitive material may be maintained stationary, and an exposure region thereof may be flattened by suction, as necessary, to realize an exposure of enhanced precision.

In this invention, it is proposed as a particularly preferred form that the above relative movement in the sub-scanning direction is produced by a stepping motor, the drive signal (emission pulses) for the luminous elements having a pulse width set based on a frequency of a pulse signal for driving the stepping motor. The speed of the stepping motor is variable with the frequency of the drive pulse signal. At low speed, a long time is taken for the movement by one dot, thereby extending the time for exposing one dot. That is, the width of the emission pulses, i.e. one emission time, may be increased. As noted above, an increase in the width of the emission pulses, i.e. one emission time, results in exposure with an increased quantity of light even if the density value of image data is the same. Thus, the width of the emission pulses is varied according to the frequency of the drive pulse signal for the stepping motor which determines the relative moving speed in the sub-scanning direction. By appropriately selecting a relative moving speed in the sub-scanning direction between the photosensitive material and the luminous blocks, the luminous blocks are adjusted to emit optimal quantities of light to photosensitive materials having different sensitivity characteristics. Such emission adjustment requires no change in the voltage applied to the anodes of the luminous elements, or no selective installation of filters.

Other features and advantages of this invention will be apparent from the following description of the embodiments to be taken with reference to the drawings.

DESCRIPTION OF THE PREFERRED EMBODIMENTS

First Embodiment

Figure 1:
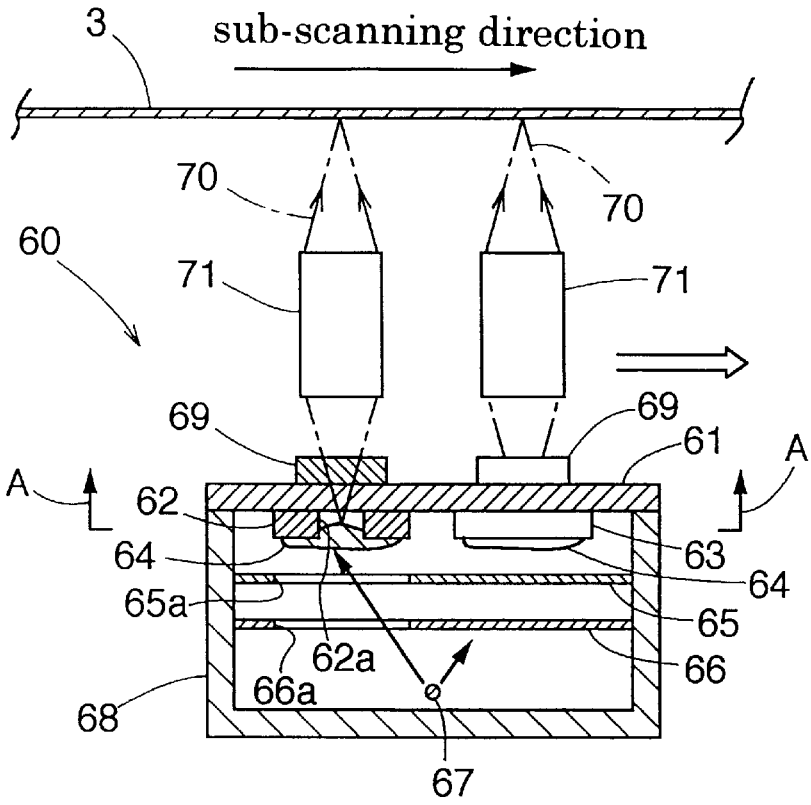
FIG. 1 is a schematic sectional view of a print head of a vacuum fluorescent printer in a first embodiment of this invention.

FIG. 1 shows a schematic sectional view of a fluorescent color print head 60. The print head 60 in this embodiment actually includes a total of four luminous blocks consisting of two R (red) luminous blocks 32*a* and 32*b*, a G (green) luminous block 33 and a B (blue) luminous block 34 (see FIG. 5). Printing paper which is one example of photosensitive materials to be printed includes a type having low sensitivity characteristics for R (red). To secure a necessary quantity of light with only one R luminous block, a long emission time would be required. To avoid such a situation, the two R luminous blocks are provided to form one dot. However, only the first luminous block 32a will be described for the purpose of illustrating the luminous blocks. The other three luminous blocks 32*b*, 33 and 34 are substantially similar in construction to the luminous block 32*a*.

A translucent substrate 61 has, on an inner surface thereof, a first strip-like anode 62 and a second strip-like anode 63 formed of thin aluminum film. As seen from FIG. 2, the strip-like anodes 62 and 63 extend in a main scanning direction at right angles to a transport direction of a photosensitive material 3 such as printing paper (the photosensitive material being referred to hereinafter simply as printing paper) exposed by the fluorescent print head 60. The anodes 62 and 63 define rectangular through-holes 62*a* and 63*a* arranged at predetermined intervals, respectively. The through-holes 62*a* in the first strip-like anode 62 and through-holes 63*a* in the second strip-like anode 63 are arranged zigzag.

Figure 2:
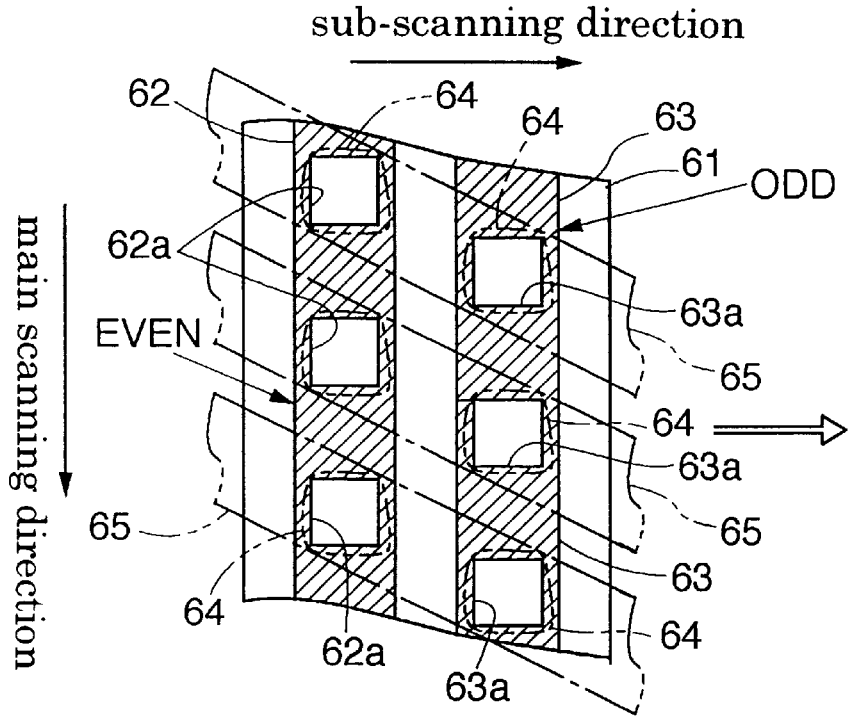
FIG. 2 is an enlarged plan view seen in the direction indicated by arrows A of FIG. 1.

Each through-hole 62*a* or 63*a* is covered with a phosphorous object 64. A plurality of grid electrodes 65 are arranged as spaced from the phosphorous objects 64 and extending in a direction traversing the main scanning direction in a corresponding relationship to the phosphorous objects 64. The grid electrodes 65 have slits 65*a* formed in areas thereof opposed to the phosphorous objects 64 to act as translucent sections. The grid electrodes 65 are electrically independent of one another, and separate control voltages are applied thereto. Further, an accelerating electrode 66 is disposed as spaced from the grid electrodes 65. This accelerating electrode 66 consists of a single metal plate defining slits 66*a* corresponding to the slits 65*a* of grid electrodes 65. A common accelerating voltage is applied to the accelerating electrode 66. Further away from the grid electrodes 65 is a filamentary cathode 67 extending in the main scanning direction. One phosphorous object 64, the first strip-like anode 62 or second striplike anode 63, one grid electrode 65 and the accelerating electrode 66 constitute a luminous element. Light emitted from each luminous element forms one-dot latent image on the printing paper 3. The column of luminous elements disposed at the right side in FIG. 2 is called an odd-numbered luminous element array ODD, and the column of luminous elements disposed at the left side in FIG. 2 is called an even-numbered luminous element array EVEN. One line of continuous dot pattern is formed by staggering emission timing of the odd-numbered luminous element array ODD and even-numbered luminous element array EVEN in an amount corresponding to a moving time covering each interval.

The above strip-like anodes 62 and 63, grid electrodes 65, accelerating electrode 66 and filamentary cathode 67 are enclosed in a vacuum space defined by the inner surface of substrate 61 and a covering 68. The substrate 61 has red filters 69 mounted on an outer surface thereof and opposed to the phosphorous objects 64 to act as color filters. Light beams 70 radiating from the phosphorous objects 64 are adjusted by the red filters 69 and caused by SELFOC lenses 71 to converge on the printing paper 3.

With a predetermined voltage applied to the filamentary cathode 67 and accelerating electrode 66, voltages are applied alternately to the first strip-like anode 62 and second strip-like anode 63, with predetermined timing of the alternation. Synchronously with the timing of alternation, a positive exposing signal is applied to selected grid electrodes 65. As a result, thermions radiating from the filamentary cathode 67 pass through slits 65*a* according to the states of grid electrodes 65, and impinge upon the phosphorous objects 64. The phosphorous objects 64 upon which the thermions impinge emit light beams. These light beams 70 travel through the through-holes to reach the printing paper 3, thereby to expose the printing paper in units of light beam dots. When, for example, all the phosphorous objects 64 emit light, the luminous elements in two arrays expose the printing paper 3 linearly with a width corresponding to one dot.

The individual luminous elements have emission characteristics variable in emission area and in spacing between electrodes. Thus, the control signals applied to the grid electrodes 65 are corrected in advance based on quantities of light actually measured under the same drive condition, so that the luminous elements provide the same quantity of light when operated under the same drive condition. As a result, light is emitted uniformly from the luminous elements.

A printer/processor employing the fluorescent print head 60 having the four luminous blocks as a fluorescent printer will be described hereinafter.

Figure 3:
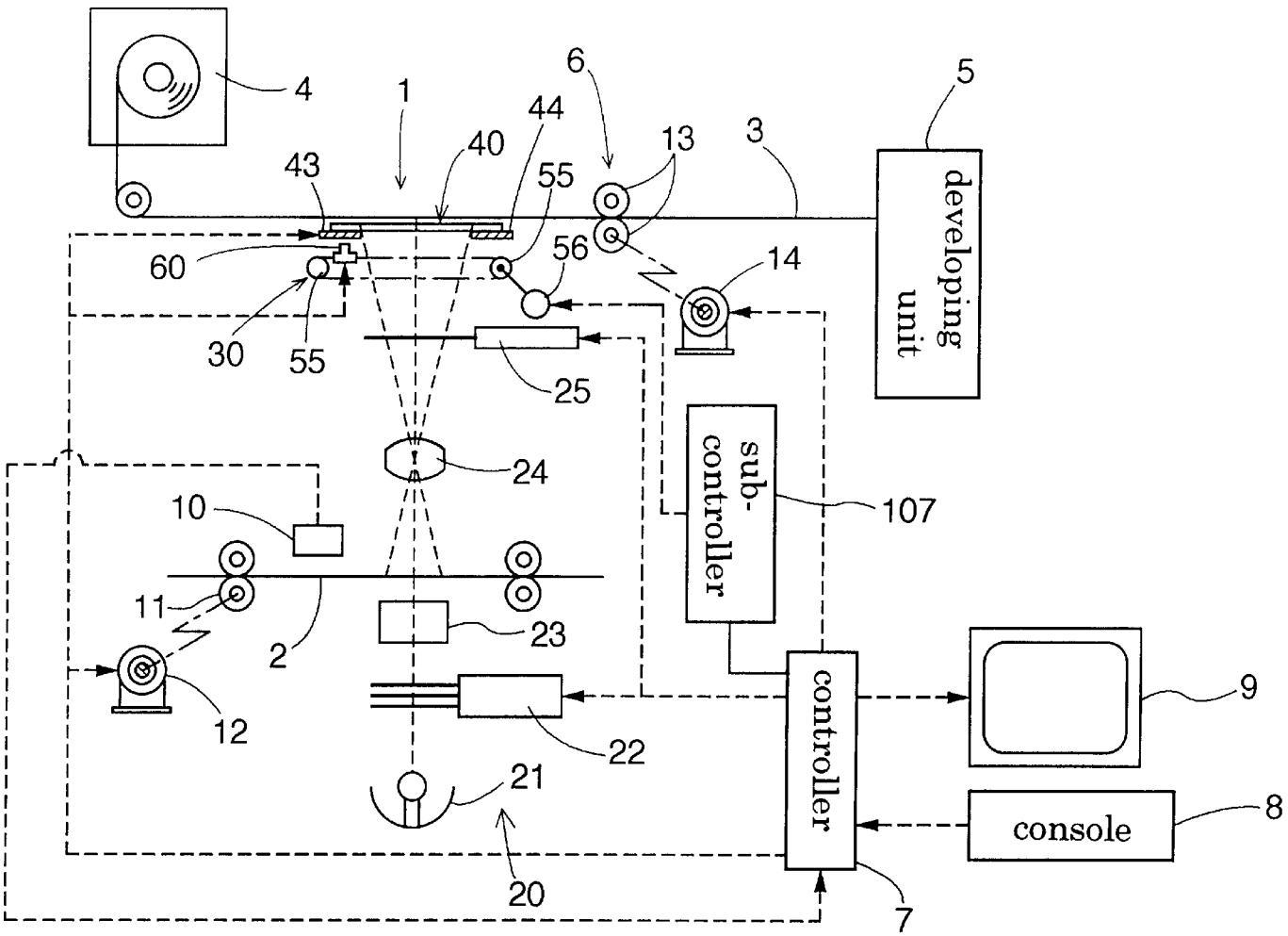
FIG. 3 is a schematic block diagram of a printer/processor employing the fluorescent printer according to this invention.

As seen from the schematic block diagram shown in FIG. 3, the printer/processor includes an optical exposing device 20 for projecting images of photographic film 2 to printing paper 3 acting as a photosensitive material, at an exposing point 1, a fluorescent printer 30 acting as a digital exposing device for forming images on the printing paper 3 based on digital image data at the same exposing point 1, a developing unit 5 for developing the printing paper 3 exposed at the exposing point 1, a printing paper transport mechanism 6 for transporting the printing paper 3 from a paper magazine 4 through the exposing point 1 to the developing unit 5, and a controller 7 for controlling the components of the printer/processor 1. A paper mask 40 is disposed at the exposing point 1 for determining an area of printing paper 3 to be exposed by the optical exposing device 20. The controller 7 has, connected thereto, a console 8 for inputting various information, and a monitor 9 for displaying pictures and characters. The controller 7 has also a sub-controller 107 connected for communication therewith to perform ancillary functions.

The printing paper 3 drawn out of the paper magazine 4 storing the printing paper 3 in a roll is exposed by the optical exposing device 20 and/or fluorescent printer 30, thereafter developed by the developing unit 5, and discharged as cut to a size including a frame of image information. It is of course possible to employ a construction for cutting the printing paper 3 to necessary lengths before exposure.

Each component will be described hereinafter.

The optical exposing device 20 includes a light source 21 for optical exposure in the form of a halogen lamp, a light adjustment filter 22 for adjusting a color balance of light for irradiating the film 2, a mirror tunnel 23 for uniformly mixing the colors of the light emerging from the light adjustment filter 22, a printing lens 24 for forming images of film 2 on the printing paper 3, and a shutter 25, all arranged on the same optical axis providing an exposure optical path.

The images formed on the film 2 are read by a scanner 10 disposed on a film transport path upstream of the optical exposing device 20. The scanner 10 irradiates the film 2 with white light, separates the light reflected from or transmitted through the film 2 into three primary colors of red, green and blue, and measures the density of the images with a CCD line sensor or CCD image sensor. The image information read by the scanner 10 is transmitted to the controller 7 for use in displaying, on the monitor 9, a simulation of each image to be formed on the printing paper 3.

Figure 4:
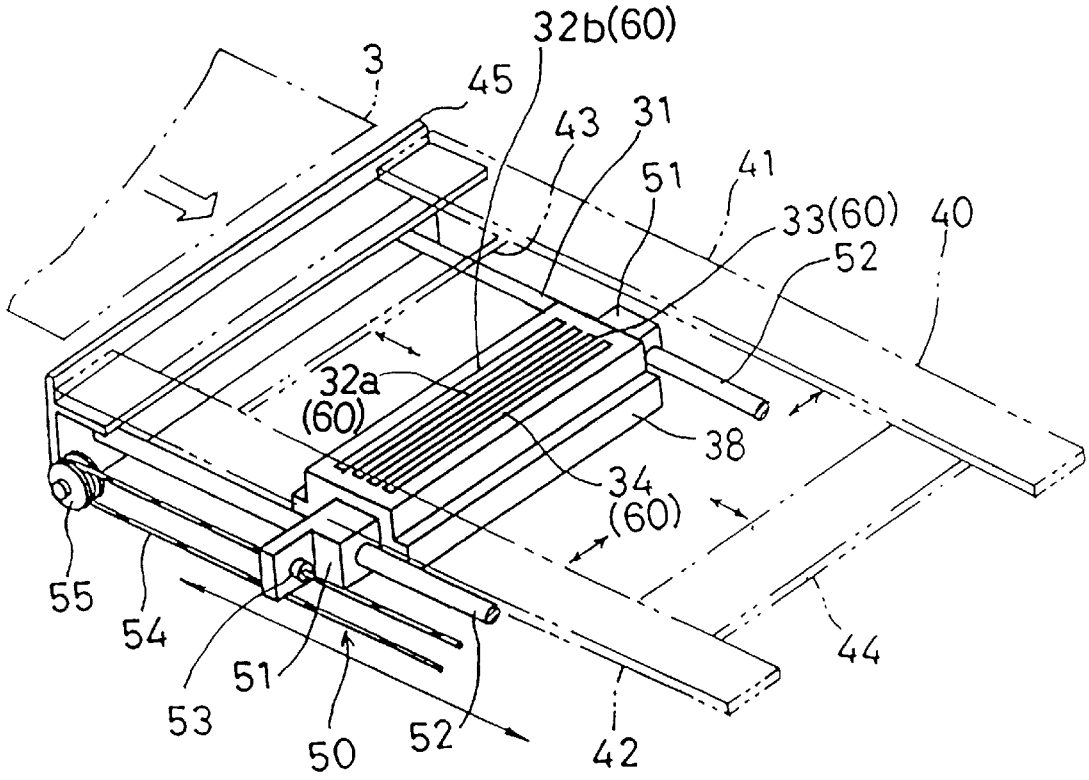
FIG. 4 is a schematic perspective view of a portion of the printer/processor including the print head.

As shown in detail in FIG. 4, the fluorescent printer 30 includes the fluorescent print head 60 having the first R luminous block 32*a*, second R luminous block 32*b*, G luminous block 33 and B luminous block 34 having the construction described hereinbefore, and a reciprocating mechanism 50 for moving the fluorescent print head 60 in the transport direction of printing paper 3. Each luminous block of fluorescent print head 60 is connected to the controller 7. The reciprocating mechanism 50 has a drive system thereof connected to the sub-controller 107. Image data and character data are printed in color on the printing paper 3 based on control of the phosphorous objects 64 by the controller 7 and scan control in the sub-scanning direction of the fluorescent print head 60 by the sub-controller 107 effected through the reciprocating mechanism 50.

Figure 5:
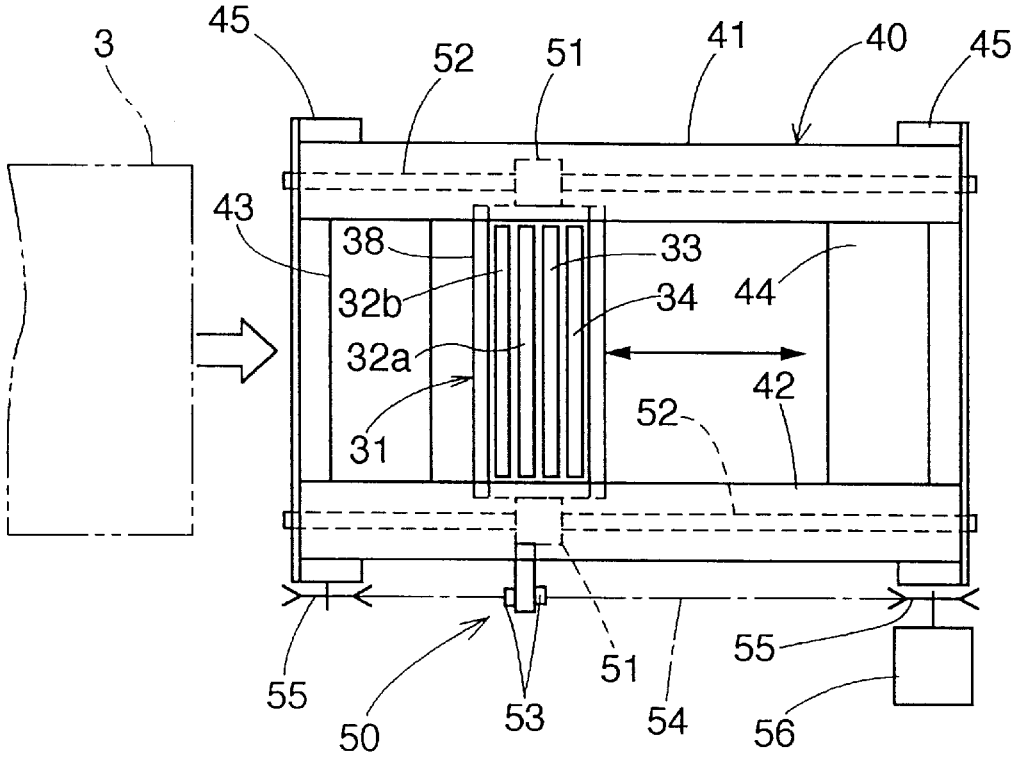
FIG. 5 is a schematic plan view of a paper mask and a mechanism for reciprocating the print head.
Figure 6:
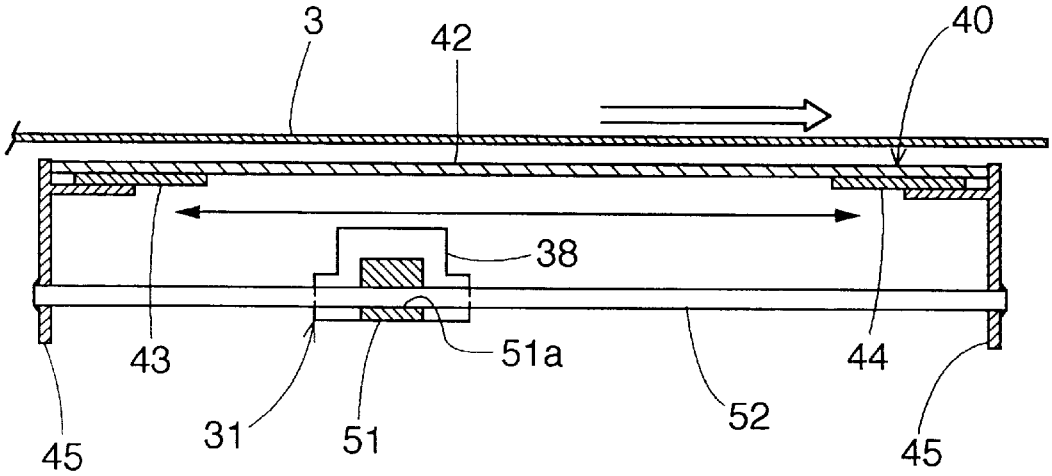
FIG. 6 is a schematic side view of the paper mask and the mechanism for reciprocating the print head.

The paper mask 40 is known per se and will not particularly be described. As schematically shown in FIGS. 5 and 6, the paper mask 40 includes an upper frame member 41 and a lower frame member 42 extending parallel to the transport direction of printing paper 3 and reciprocable transversely of the transport direction, a left frame member 43 and a right member 44 extending transversely of the transport direction of printing paper 3 and reciprocable in the transport direction, and a base frame 45 for supporting these members. A distance between the upper frame member 41 and lower frame member 42 determines an exposing range transversely of the printing paper 3. A distance between the left frame member 43 and right member 44 determines an exposing range longitudinally of the printing paper 3. The upper frame member 41, lower frame member 42, left frame member 43 and right member 44 are movable by a drive mechanism not shown, under control or the controller 7.

The reciprocating mechanism 50 for moving the fluorescent print head 60 is attached to the base frame 45 of paper mask 40. The reciprocating mechanism 50 basically includes guide members 51 attached to opposite sides of fluorescent print head 60, guide rails 52 extending through guide bores 51*a* formed in the guide members 51, a wire clamp 53 attached to one of the guide members 51, a wire 54 secured at one end thereof to the wire clamp 53, sprockets 55 arranged at opposite ends of the base frame 45 and having the wire 54 wound therearound, and a stepping motor 56 for rotating one of the sprockets 55 under control of the sub-controller 107. Rotation of the stepping motor 56 causes the fluorescent print head 60 through the wire 54 to move along the guide rails 52.

Figure 7:
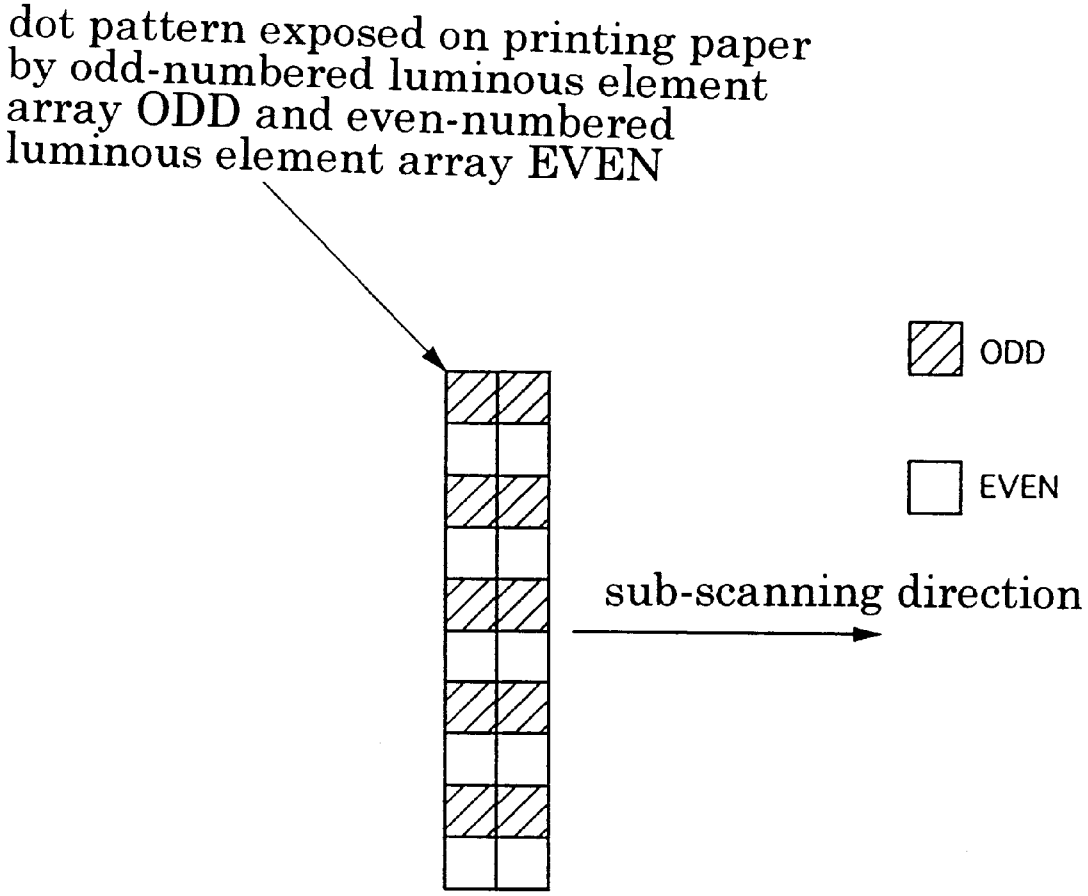
FIG. 7 is a schematic view of a dot pattern formed on printing paper.

FIG. 7 shows a dot pattern of two lines, each line including ten dots, formed by using the first R luminous block 32*a* and second R luminous block 32*b*. A sequence of forming this dot pattern will be described with reference to a schematic time chart shown in FIG. 8.

In the dot pattern shown in FIG. 7, the hatched dots are formed by the odd-numbered luminous element array ODD of each luminous block, and the other dots by the even-numbered luminous element array EVEN of each luminous block. All the dots are exposed first by the first R luminous block 32*a*, and then further exposed by the second R luminous block 32*b*.

To describe exposure of one dot in detail, an image data of one dot (one pixel) is a density data giving a brightness to this dot, which is expressed with a resolution of 256 shades in this embodiment. When the density data has a value of 255, standard light emission is repeated 255 times. When the density data has a value of 128, standard light emission is repeated 128 times. When the density data has a value of 0, no light emission takes place. Such light emission for each dot is made from the luminous elements driven by emission pulses during movement in the sub-scanning direction by one dot.

Figure 8:
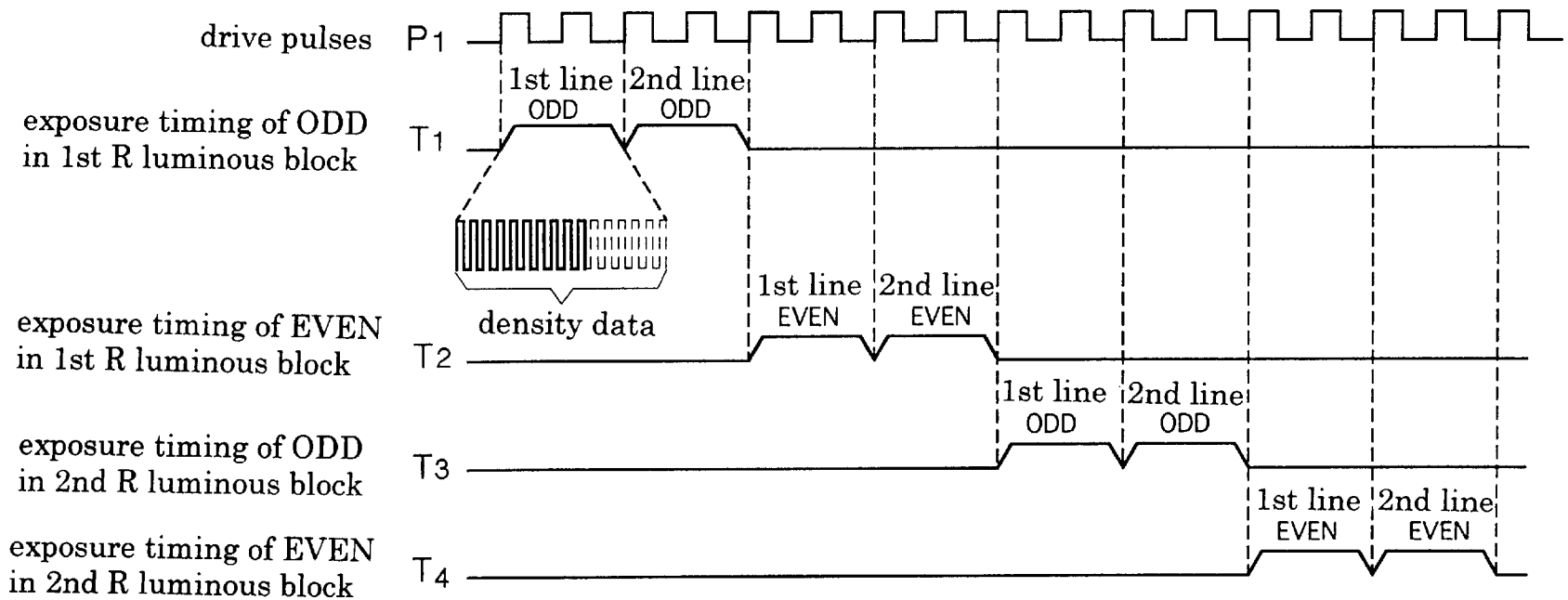
FIG. 8 is a time chart schematically showing exposure timing of a first R luminous block and a second R luminous block.

In FIG. 8, reference P1 denotes a drive pulse signal for controlling movement in the sub-scanning direction of the print head 60. In this example, two pulses move the print head 60 by a distance corresponding to one dot. Thus, during two cycles of drive pulse signal P1, the odd-numbered luminous element array ODD of the first R luminous block 32*a*, based on density data, exposes odd-numbered dots of a first line, and thereafter exposes odd-numbered dots of a second line. Reference Ti denotes such exposure timing of the odd-numbered luminous element array ODD of the first R luminous block. Further, as seen from exposure timing T2 of the even-numbered luminous element array EVEN of the first R luminous block 32*a*, when the first line having the above dot pattern comes under the even-numbered luminous element array EVEN of the first R luminous block 32*a*, the even-numbered luminous element array EVEN, based on density data, exposes even-numbered dots of the first line, and thereafter exposes even-numbered dots of the second line. This completes the exposure of the dot pattern of FIG. 7 by the first R luminous block 32*a*. Further, as shown in exposure timing T3 of the odd-numbered luminous element array ODD of the second R luminous block 32*b*, when the first line of the above dot pattern comes under the odd-numbered luminous element array ODD of the second R luminous block 32*b*, the odd-numbered luminous element array ODD of the second R luminous block 32*b*, based on the same density data as used by the first R luminous block 32*a*, exposes the odd-numbered dots of the first line, and thereafter exposes the odd-numbered dots of the second line. Similarly, the even-numbered luminous element array EVEN of the second R luminous block 32*b* carries out exposure as shown at exposure timing T4.

Exposure by the G luminous block 33 and B luminous block 34 is omitted from FIG. 8 to avoid repetition of a similar description. For color exposure, the three RGB luminous blocks 32*a*, 32*b*, 33 and 34 are of course used.

With the above operation, a multiple exposure is made of the dot pattern of FIG. 7 by the first R luminous block 32*a* and second R luminous block 32*b* to provide the printing paper 2 with a large quantity of light.

Figure 9:
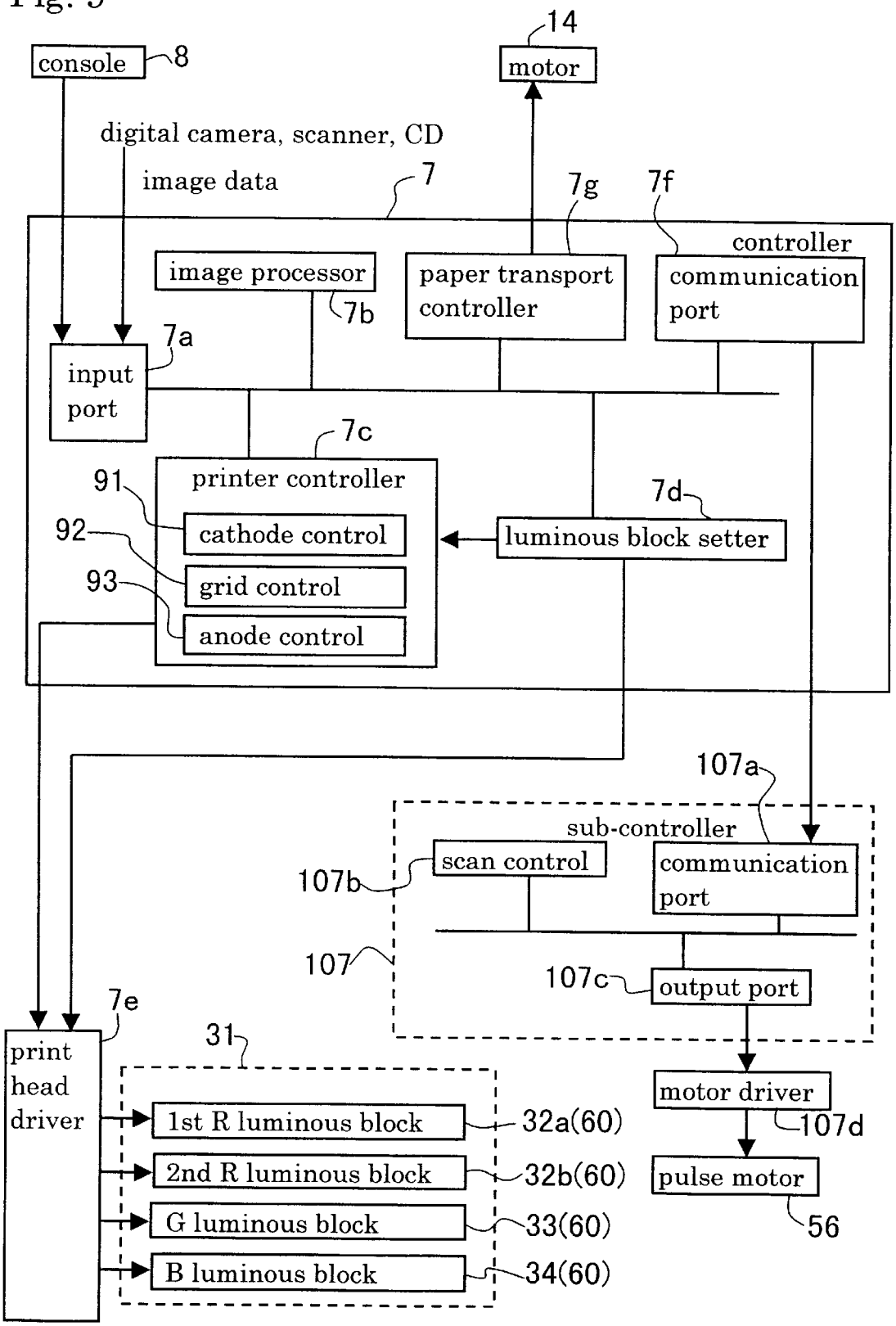
FIG. 9 is a functional block diagram illustrating an emission control of the fluorescent printer.

FIG. 9 is a block diagram schematically showing controls of the fluorescent print head 60 for exposing the printing paper 3. The controller 7 includes an image data input port 7*a* connected to the console 8 and to a device such as a digital camera, scanner or CD to acquire digital images, an image processor 7*b* for processing image data inputted or digitized character data and producing luminance data divided on a dot-by-dot basis into 256 shades, a printer controller 7*c* for setting conditions for driving the fluorescent print head 60, and a luminous block setter 7*d* for additionally driving the second R luminous block 32*b* in response to sensitivity characteristics of printing paper 3. The printer controller 7*c* includes a cathode control unit 91 for controlling cathode voltage, a grid control unit 92 for controlling grid voltage, and an anode control unit 93 for controlling anode voltage.

The grid control unit 92 transmits density data of each color received from the image processor 7*b* to a print head driver 7*e* as the number of emission pulses for one dot. The luminous block setter 7*d* transmits a drive ON/OFF signal for the second R luminous block 32*b* to the printer controller 7*c* and print head driver 7*e*. When the drive signal for the second R luminous block 32*b* is ON, the second R luminous block 32*b* is driven to effect exposure based on the exposure timing illustrated in FIG. 8.

The controller 7 further includes a communication port 7*f* connected to a communication port 107*a* of sub-controller 107. The sub-controller 107 includes a scan control unit 107*b* for generating control signals relating to scanning speed and timing of fluorescent print head 60. The sub-controller 107 cooperates with the controller 7 to transmit a drive pulse signal of predetermined frequency to the stepping motor 56 through an output port 107*c* and a motor driver 107*d*. With this cooperation of controller 7 and sub-controller 107, an image is printed by the fluorescent print head 60 in a predetermined position of printing paper 3.

An outline of operation of the printer/processor will be described next.

When a film 2 is fed to the optical exposing device 20 by rollers 11 driven by a motor 12, the controller 7 controls the light adjustment filter 22 based on the image information of film 2 read by the scanner 10. As a result, the irradiating light from the light source 21 is adjusted to a color balance corresponding to the color density of an image on the film 2. The optical exposing device 20 irradiates the film 2 with the adjusted light. The image information of the film 2 is projected as transmitted light to the printing paper 3 located at the exposing point 1, to print the image of film 2 on the printing paper 3. The fluorescent print head 60 of fluorescent printer 30 is operated, as necessary, to print additional characters and an illustration such as a logo mark in a peripheral position of an area printed by the optical exposing device 20. When an image photographed with a digital camera is printed on the printing paper 3, only the fluorescent printer 30 is operated to print the image on the printing paper 3 located at the exposing point 1.

The printing paper 3 having an image printed thereon at the exposing point 1 is transported to the developing unit 5 by the paper transport mechanism 6 having a plurality of rollers 13 and a motor 14 controllable by a paper transport controller 7*g* of controller 7 to drive these rollers 13. The printing paper 3 is developed by being passed successively through a plurality of tanks storing treating solutions for development. This paper transport mechanism 6 functions also to stop the printing paper 3 drawn out of the paper magazine 4 in a predetermined position at the exposing point 1. Thus, where a mode is employed to continue transporting the exposed printing paper 3 to the developing unit 5, the paper transport mechanism 6 may be divided at the exposing point 1 into an upstream portion and a downstream portion with respect to the transport direction, and driven independently of each other.

The above embodiment has been described in relation to the color fluorescent printer. A monochromatic fluorescent printer will include only one basic luminous block and an additional luminous block. A further description thereof is believed unnecessary.

Figure 10:
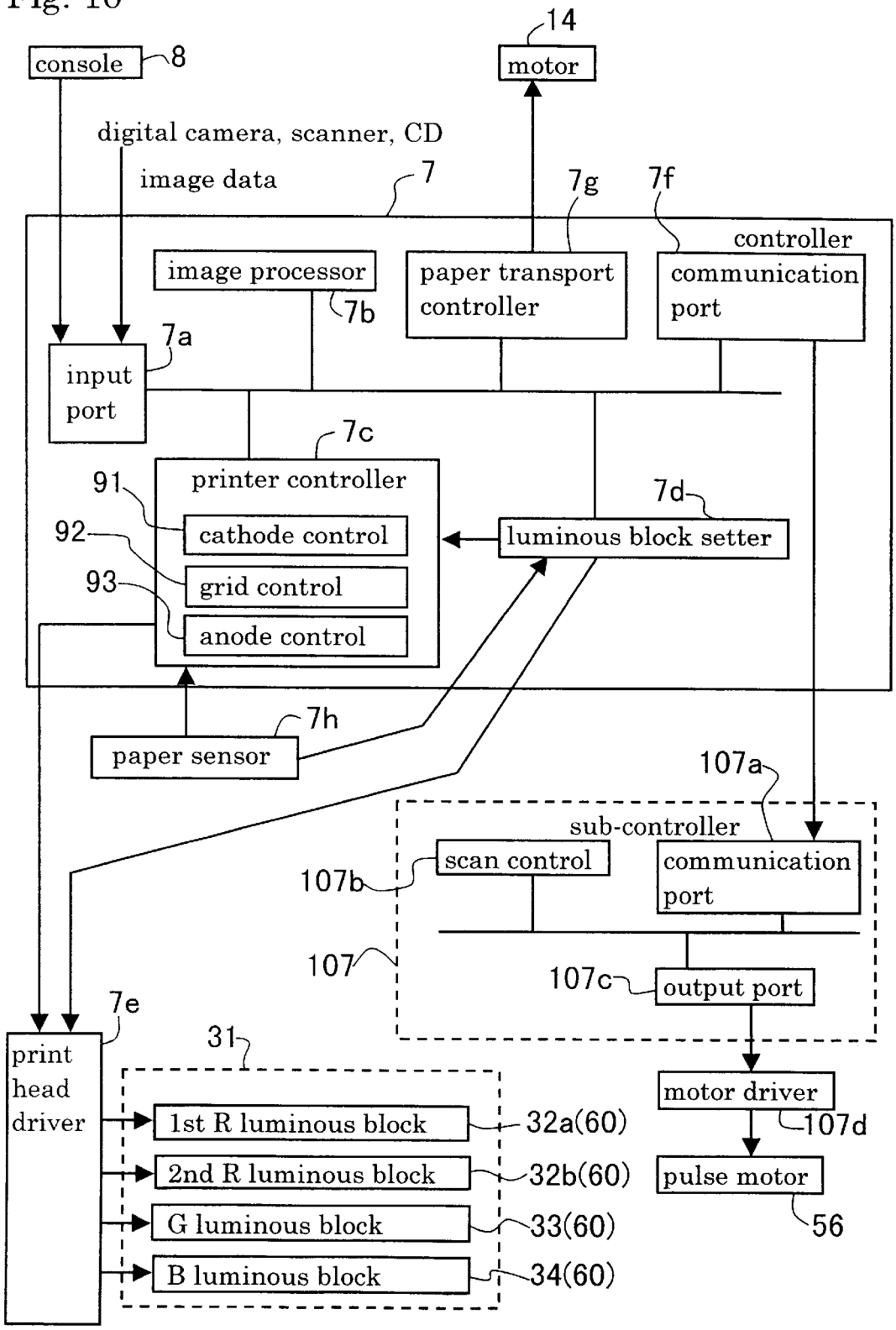
FIG. 10 is a functional block diagram illustrating an emission control of a modified fluorescent printer.

FIG. 10 shows a functional block diagram of a different type of fluorescent printer. In this printer, the luminous block setter 7*d* determines, based on results of detection by a paper sensor 7*h* which detects the type of printing paper 3, whether to drive the second R luminous block 32*b* or not. When it is determined that the second R luminous block 32*b* should be driven, the printer controller 7*c* sets anode voltages for adjusting quantities of light to be emitted from the luminous blocks 32*a*, 32*b*, 33 and 34. Thus, when one type of printing paper is changed to another type, the intensity of exposure is varied automatically.

In the embodiment described above, the additional luminous block is only the R luminous block 32*b*. It is of course possible to provide additional luminous blocks for other colors as well. The number of such additional blocks may be determined as appropriate.

Second Embodiment

Figure 11:
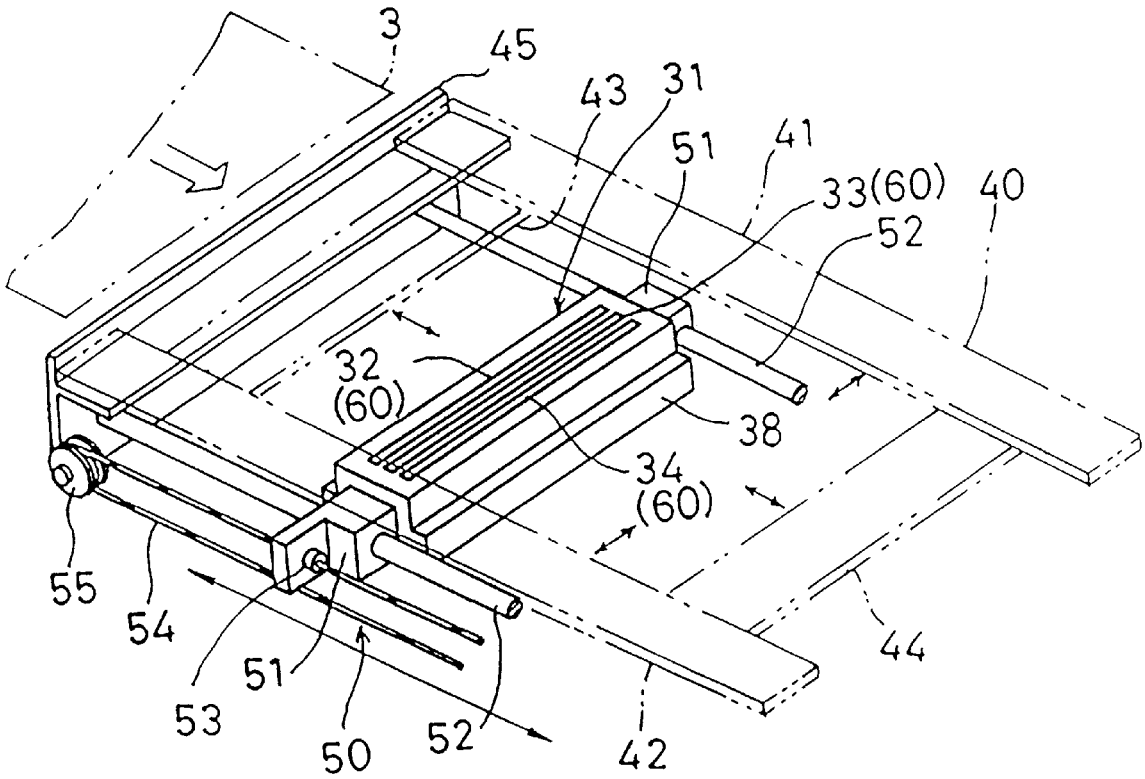
FIG. 11 is a schematic perspective view of a portion of the printer/processor including a print head in a second embodiment.

The fluorescent printer in this embodiment, as distinct from the preceding embodiment, does not include an additional luminous block. As shown in FIG. 11, this fluorescent print head 60 includes one R (red) luminous block 32, one G (green) luminous block 33 and one B (blue) luminous block 34. Adjustment of quantities of light is carried out according to varied sensitivity characteristics of printing paper 3 by controlling the drive signal. The control of the drive signal will be described hereinafter with reference to FIGS. 12 and 13.

An image data of one dot (one pixel) is a density data giving a brightness to this dot, which is expressed with a resolution of 256 shades in this embodiment. When the density data has a value of 255, standard light emission is repeated 255 times. When the density data has a value of 128, standard light emission is repeated 128 times. when the density data has a value of 0, no light emission takes place. Such light emission for each dot is made from the luminous elements driven by emission pulses during movement in the sub-scanning direction by one dot.

Figure 12A:
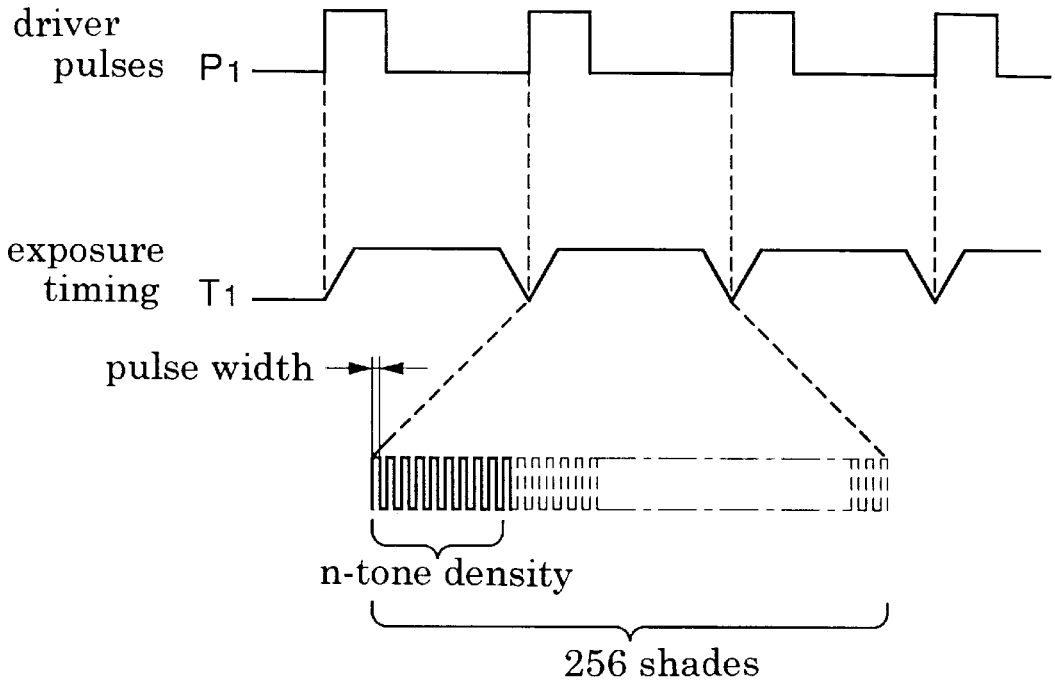
FIGS. 12A and 12B are time charts schematically showing a relationship between moving speed and emission control of luminous blocks.
Figure 12B:
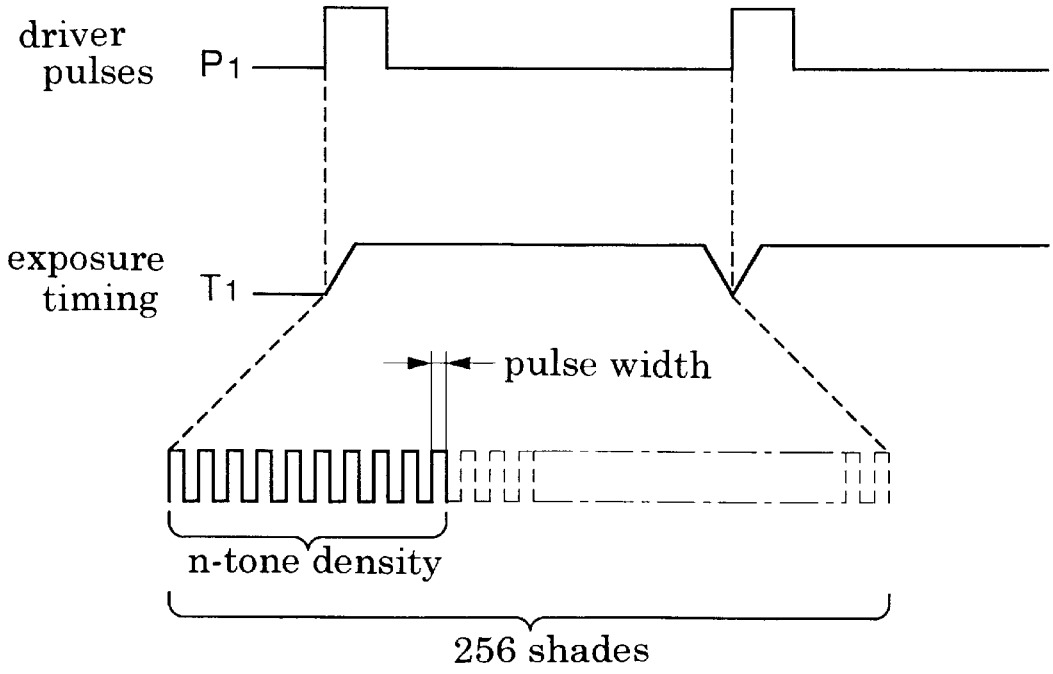

FIGS. 12A and 12B illustrate this feature in schematic time charts disregarding control accuracy. Reference P1 denotes a drive pulse signal for controlling movement in the sub-scanning direction of the print head 60. In this example, one pulse moves the print head 60 by one dot. Thus, one cycle of drive pulse signal P1 corresponds to a period of time allocated for exposing one dot. Reference Ti denotes such exposure timing. The period of time allocated for exposing one dot is divided into 255 equal parts. Emission pulses have a width not exceeding the length of one such part, whereby the dots may have 256 different shades. One light emission is made by applying a control voltage to a grid electrode 65 for a time corresponding to the width of an emission pulse to radiate a light beam from a phosphorous object 64. FIG. 12A shows a case where the print head 60 moves fast in the sub-scanning direction. FIG. 12B shows a case where the print head 60 moves slowly in the sub-scanning direction. When the moving speed in the sub-scanning direction is slow, a long period of time is allocated for exposing one dot. Thus, the emission pulses are set to a correspondingly large width. As a result, an increased quantity of light is emitted for exposure even though the density data is unchanged. That is, the width of the emission pulses is varied in inverse proportion to the frequency of drive pulse signal P1 which determines the moving speed in the sub-scanning direction.

Figure 13:
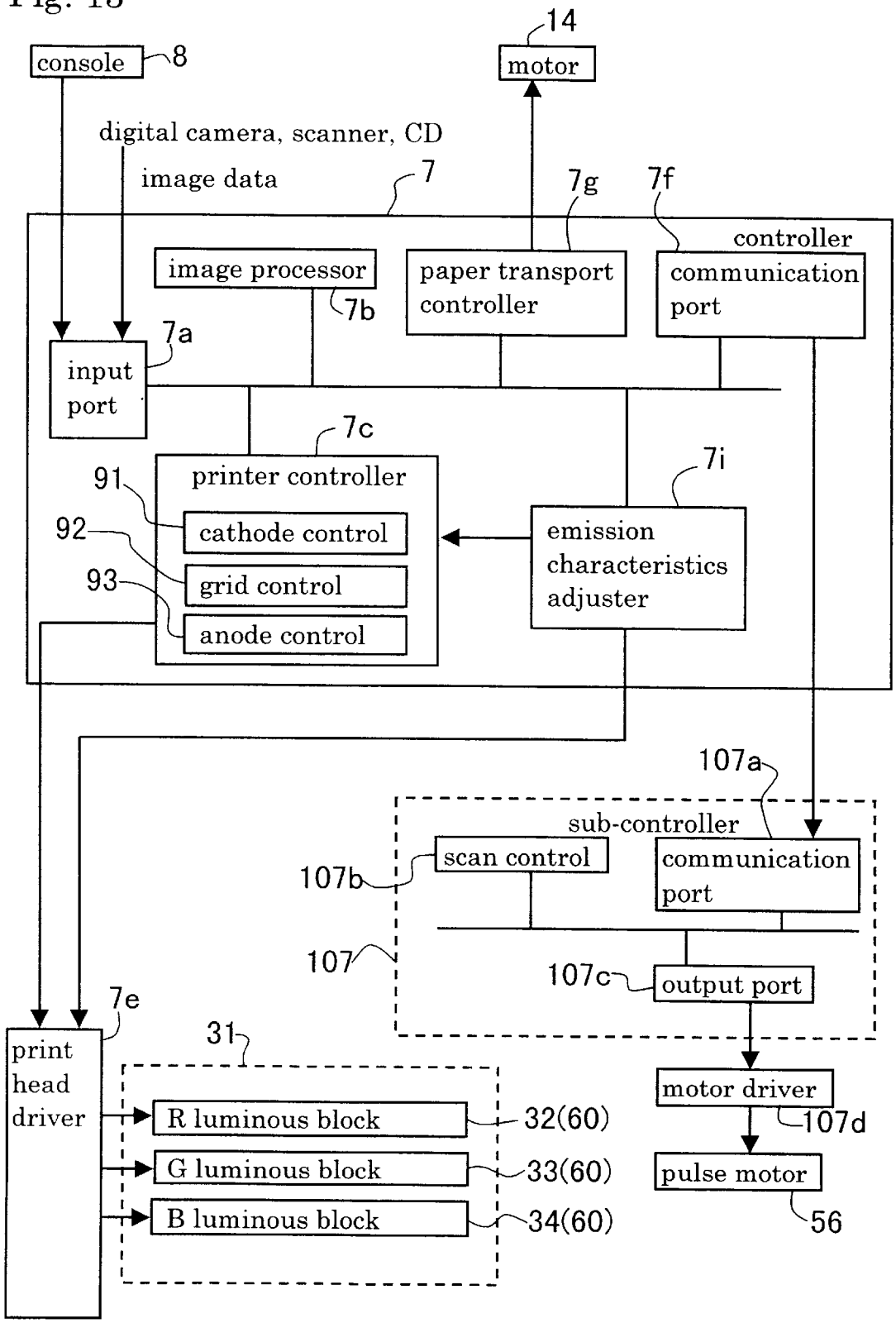
FIG. 13 is a functional block diagram illustrating an emission control of a fluorescent printer in the second embodiment.

As seen from FIG. 13, the controller 7 includes an image data input port 7*a* connected to the console 8 and to a device such as a digital camera, scanner or CD to acquire digital images, an image processor 7*b* for processing image data inputted or digitized character data and producing luminance data divided on a dot-by-dot basis into 256 shades, a printer controller 7*c* for setting conditions for driving the fluorescent print head 60, and an emission characteristics adjuster 7*i* for varying the width of the emission pulses with a rotating rate of stepping motor 56 to set the luminous blocks 32, 33 and 34 to emission characteristics corresponding to sensitivity characteristics of printing paper 3.

The printer controller 7*c* includes a cathode control unit 91 for controlling cathode voltage, a grid control unit 92 for controlling grid voltage, and an anode control unit 93 for controlling anode voltage. The grid control unit 92 transmits density data of each color received from the image processor 7*b* to a print head driver 7*e* as the number of emission pulses for one dot. The emission characteristics adjuster 7*i* transmits a signal to the print head driver 7*e* for determining a width of the emission pulses for each luminous block. As a result, appropriate emission pulses may be transmitted to the R luminous block 32, G luminous block 33 and B luminous block 34 of fluorescent print head 60.

The controller 7 further includes a communication port 7*f* connected to a communication port 107*a* of sub-controller 107. The sub-controller 107 includes a scan control unit 107*b* for generating control signals relating to scanning speed and timing of fluorescent print head 60. The sub-controller 107 cooperates with the controller 7 to transmit a drive pulse signal of predetermined frequency to the stepping motor 56 through an output port 107*c* and a motor driver 107*d*. The frequency of the drive pulse signal is determined by the emission characteristics adjuster 7*i* in response to the sensitivity characteristics of printing paper 3 inputted from the console 8. With this cooperation of controller 7 and sub-controller 107, an image is printed by the fluorescent print head 60 in a predetermined position of printing paper 3.

Figure 14:
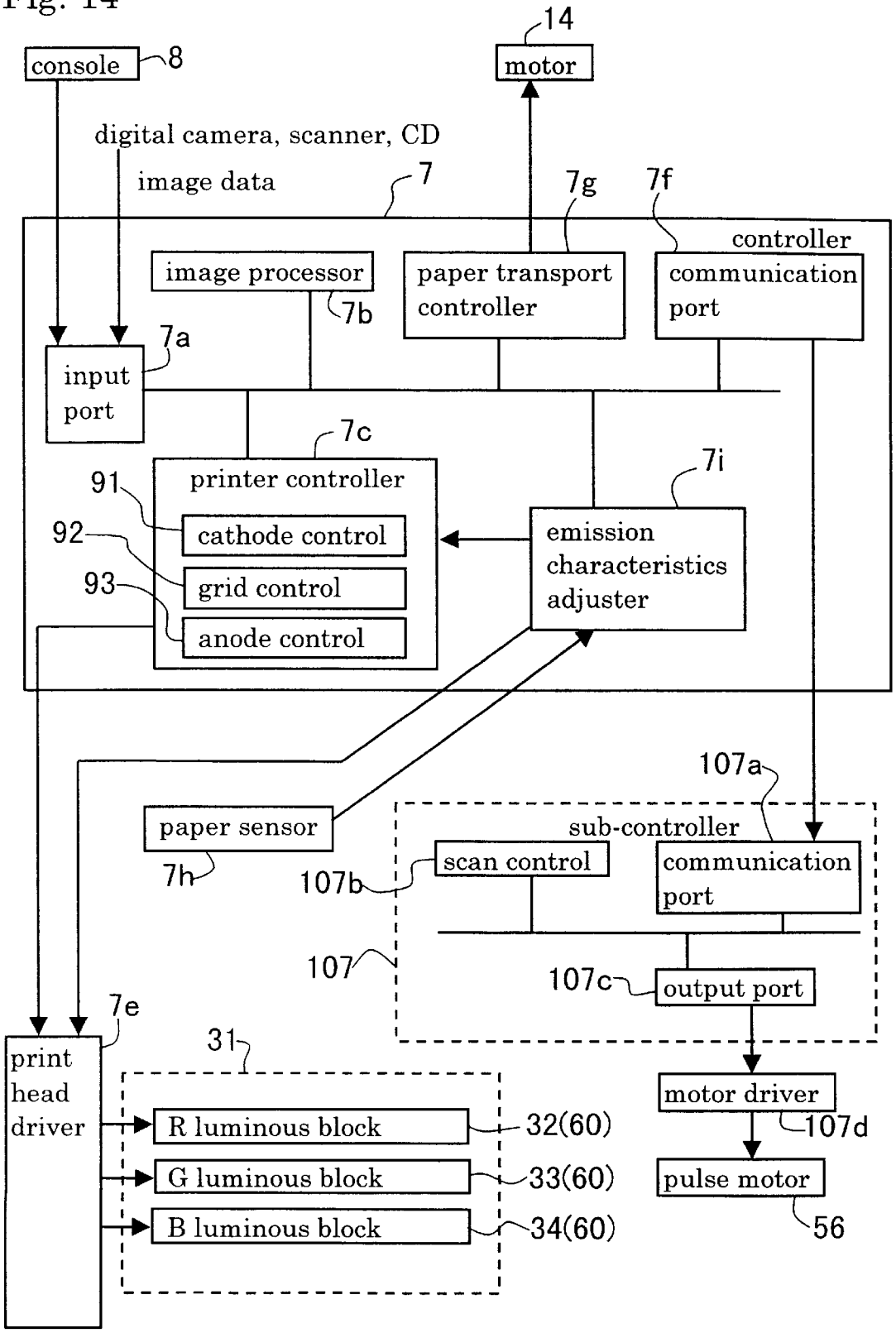
FIG. 14 is a functional block diagram illustrating an emission control of a modified fluorescent printer in the second embodiment.

As shown in FIG. 14, this embodiment may also include a paper sensor 7*h* for detecting the type of printing paper 3. In this case, the emission characteristics adjuster 7*i*, based on a result of detection by the paper sensor 7*h*, determines emission characteristics of the respective luminous blocks, and the printer controller 7*c* determines a frequency of the drive pulse signal transmitted to the stepping motor 56.

In the foregoing embodiments, the fluorescent print head 60 is movable over the printing paper 3 to expose a predetermined area of printing paper 3. Alternatively, the fluorescent print head 60 may be fixed to a predetermined position at the exposing point 1, with the printing paper 3 moved to expose only a predetermined area thereof.

This may be achieved, in the second embodiment, by using a stepping motor as the motor 14 of paper transport mechanism 6, the frequency of the drive pulse signal therefor being set by the emission characteristics adjuster 7*i*. In times other than when the fluorescent print head 60 is operated for exposure, the motor 14 is of course driven by a drive pulse signal with a frequency for achieving a paper transport speed determined separately and with no relation to the emission characteristics adjuster 7*i*.

What is claimed is:

1. A vacuum fluorescent printer for forming an image based on image data on a photosensitive material, comprising:

a print head movable in a sub-scanning direction relative to said photosensitive material, and including:

a luminous block having a plurality of luminous elements arranged in a main scanning direction for irradiating said photosensitive material with light released from phosphorous objects to which electrons are applied based on a drive signal, thereby forming dots on said photosensitive material; and a printer controller for generating a pulsed drive signal as said drive signal, said pulsed drive signal having a pulse width corresponding to a time period of irradiation of the light;

wherein the number of pulses in said drive signal is determined based on a density value of the image data, and the pulse width of said pulsed drive signal is variable such that the pulse width becomes larger according as the moving speed of said print head in said sub-scanning direction relative to said photosensitive material becomes slower.

2. A vacuum fluorescent printer as defined in claim 1, wherein a relative movement in said sub-scanning direction between said print head and said photosensitive material is produced by a transport mechanism for transporting said photosensitive material.

3. A vacuum fluorescent printer as defined in claim 1, wherein said luminous blocks are movable in said sub-scanning direction by a reciprocating mechanism, a relative movement in said sub-scanning direction between said print head and said photosensitive material being produced by said reciprocating mechanism.

4. A vacuum flourescent printer as defined in claim 1, wherein the relative movement in said sub-scanning direction between said print head and said photosensitive material is produced by a stepping motor operable based on a pulsed motor drive signal and said pulse width of the pulsed drive signal for driving said luminous block is set based on frequency of said pulsed motor drive signal.

* * * * *

UNITED STATES PATENT AND TRADEMARK OFFICE

CERTIFICATE OF CORRECTION

PATENT NO. : 6,208,365 B1
DATED : March 27, 2001
INVENTOR(S) : Nakamura, et al.

It is certified that error appears in the above-identified patent and that said Letters Patent is hereby corrected as shown below:

Title page,
In the section entitled References, change "4/1999" to -- 5/1998 --.

Column 8,
Line 32, change "Ti" to -- T1 --.

Column 10,
Line 51, change "Ti" to -- T1 --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*